United States Patent [19]

Nielson

[11] Patent Number: 4,928,765

[45] Date of Patent: May 29, 1990

[54] METHOD AND APPARATUS FOR SHALE GAS RECOVERY

[75] Inventor: Donald H. Nielson, Salt Lake City, Utah

[73] Assignee: Ramex Syn-Fuels International, Nev.

[21] Appl. No.: 249,649

[22] Filed: Sep. 27, 1988

[51] Int. Cl.[5] ..... E21B 43/243

[52] U.S. Cl. ..... 166/251; 166/257; 166/302

[58] Field of Search ..... 166/251, 257, 256, 272, 166/302, 59, 61, 64, 242; 299/14, 3; 431/2, 202, 350, 353; 175/12

[56] References Cited

U.S. PATENT DOCUMENTS

| | | | |
|---|---|---|---|
| 2,767,793 | 10/1956 | Kramer | 166/61 |
| 2,911,047 | 11/1959 | Henderson | 166/61 |
| 3,298,434 | 1/1967 | Graham | 166/257 |
| 3,712,375 | 1/1973 | Berry et al. | 166/251 |
| 3,952,801 | 4/1976 | Burton, III | 166/59 |
| 3,990,835 | 11/1976 | Burton, III | 166/59 |
| 4,067,390 | 1/1978 | Camacho et al. | 166/302 |
| 4,089,372 | 5/1978 | Terry | 166/256 |
| 4,205,725 | 6/1980 | Howard et al. | 166/59 |
| 4,304,308 | 12/1981 | Munding et al. | 166/61 |

FOREIGN PATENT DOCUMENTS

| | | |
|---|---|---|
| 144908 | 2/1948 | Australia . |
| 162337 | 4/1921 | United Kingdom . |

*Primary Examiner*—Bruce M. Kisliuk

[57] ABSTRACT

A process for the in situ gasification of shale avoids the necessity of initially fracturing the shale bed and includes the placement of a gas-fired heater assembly within a bore hole followed by the application, from above ground, of fuel gas and combustion air, both of which are regulated to maintain an initial start-up temperature of over 1000 degrees F. and thereafter a constant temperature of below 1500 degrees F. throughout a reaction zone formed in the surrounding shale bed. Specifically, a production temperature of 1200 degrees F. has been found most desirable. By maintenance of this temperature, voids created in the reaction zone as kerogen is retorted to evolve natural gas, become black body radiators assisting to insure a sustained, constant high volume extraction of natural gas having a BTU value of over 800 and devoid of any liuqids. The apparatus includes the provision of fuel gas and combustion air supply lines leading from above ground to the interior of the heater assembly, together with a product gas line having a gas extraction opening through the side wall of the heater assembly adjacent its top.

3 Claims, 2 Drawing Sheets

90
CONTROL BLDG.
EXHAUST
42
86
38
34
30
36
84
PRODUCT RECEIVER
88
BLOWER
PROPANE TANK
28
OVERBURDEN
-16-
26
12
76
66
66
70
-14-
82
70
HEATER
18
68
64
72
72
74
10
78
SHALE FORMATION

METHOD AND APPARATUS FOR SHALE GAS RECOVERY

BACKGROUND OF THE INVENTION

This invention relates generally, to the recovery of natural gas from shale and more particularly, to an improved method and apparatus for such recovery in situ.

The vast extent of organic sedimentary deposits underlying the U.S. land area has long been recognized for its potential yield of energy-rich fuels. In terms of land mass, the largest deposit comprises the Devonian-Mississippian black shale composite while the highest organic content is found in the Green River formation, located in Colorado, Wyoming and Utah.

Following the recongized petroleum crisis of the past decade, billions of dollars were expended by industry and governments to research and develop methods and apparatus for recovering oil, and to some extent gas, from this shale. For the most part these efforts have been shelved and no known commercial production of oil or gas from shale is evident in this country. This is attributable to several factors, not the least of which is economics. In the case of above ground processes, shale is mined and then retorted to extract the oil and/or gas therefrom, following which the spent shale must be disposed of. The capital expenditures of such an operation are enormous even when terrain, accessibility and availability of disposal areas are of minimal concern. The alternative recovery process involves in situ operations wherein bore holes drilled into a subterranean shale deposit are combined with various apparatus intended to recover oil and/or gas from the surrounding shale.

Although the above latter approach substantially reduces the handling and disposal problems attendant with the above-ground mining process and thus curtails the overall capital outlay, the efficiency and productivity of existing processes fall far short of that required for an economical operation. In the case of oil recovery, the very impermeability of oil shale beds requires the employment of means, not heretofore adequately developed, to fracture or otherwise make available the shale deposit for whatever retort process is being utilized for the extraction of the oil therefrom. In the case of gas recovery, to which this invention is especially directed, no known process or apparatus, until the instant development, has yet demonstrated an economical manner for taking advantage of this impermeability factor to yield natural gas from the shale in situ, particularly in view of the drop in world oil prices from the levels of the past decade.

To be considered economically feasible, a recovery system must be capable of functioning when applied to shale as located at any depth, even at the most minimum of depths such as when the overburden may extend only five feet in depth, thereby avoiding the necessity of drilling bore holes of extreme depths. Additionally, a viable system should not require any moving parts and should, once in place and operational, be capable of producing commercially acceptable gas for an extended period of time, such as for five years. And even more important, the gas as produced should continuously yield over 70 MCF per day at no less than 800 BTU. To accomplish all of the foregoing, improved heating means associated with appropriate control means must be provided and operated within strict parameters, as proposed by the present invention.

DESCRIPTION OF THE RELATED ART

Several efforts have been made in the past to achieve the general, in situ recovery of hydrocarbons from oil shale. Martin Pat. No. 2,630,307 issued March 3, 1953, Durie Pat. No. 3,407,003 dated October 22, 1968 and Pat. No. 4,703,798 issued November 3, 1987 to Friedman each discloses the recovery of oil from a shale deposit and wherein one or more downhole devices are utilized in combination with fracturing or explosion of the shale bed to overcome the impermeability of the shale and allow the subsequent extraction of oil from the exposed kerogen. The extraction of hydrocarbon vapors or gases by means of processes including the use of downhole heating devices is broadly shown in both British Pat. No. 162,337 dated April 25, 1921 and Australian Pat. No. 144,908 dated February 1, 1952. Downhole heating devices per se, are exemplified in U.S. Pat. No. 2,902,270 issued September 1, 1959 to Salomonsson et al, U.S. Pat. No. 3,680,636 dated August 1, 1972 to Berry et al and U.S. Pat. No. 4,570,715 issued February 18, 1986 to Van Meurs et al. All of the above prior patents disclosed systems which lack the unique structure, relationships and productivity of the present invention as fully described hereinafter. At best, prior systems have yielded economically unacceptable volumes of low BTU value gas and often including significant amounts of liquid which must be separated out before any use of the gas could be made. Even then, the volume and values of the gas would not permit direct connection into a regional or national natural gas transmission line.

SUMMARY OF THE INVENTION

By the present invention, an improved process and apparatus is provided for an enhanced economical gasification of shale as accomplished in situ, as a result of the controlled application of heat by means of a downhole heater within a subterranean shale bed deposit. Field tests have shown that by closely regulating the output of the heating source, the combined effect of conductive and radiant heat, producing an operating temperature of approximately 1200 degree F. may be readily maintained throughout a substantial diameter surrounding the heater-containing borehole, to yield a substantial volume of commercially acceptable gas. More specifically, during start-up, heat is applied at a temperature above 1000 degrees F. to initiate the reaction and thereafter maintained below 1500 degrees F. as the shale decomposes.

Calculation of the total heat transfer versus temperature of any process comprises the total of the heat transfer of conduction, convection and radiation. Within the shale bed formation there are no convective currents and thus, only the conductive and radiant heat transfer need be considered. A graph of the heat transfer of conduction plots out as a straight line, slightly inclined upwardly in the direction of increasing temperature. Plotting out the heat transfer of radiation produces a graph wherein, at 1000 degrees F. the line intersects the line as produced on the conduction graph. Experimental shale work in the past has concentrated on processes wherein temperatures are produced just below this 1000 degree F. point. Analyses of the present process have shown that by operating at 1200 degrees F., the optimum amount of conductive heat transfer contributes about 1000 degrees to the shale body while radiant heat transfer comes into play above that point. Plotted out, it is found that when operating at 1200 degrees, approximately four times the heat transfer rate is achieved by that 200 degree increase in temperature. A notable benefit of operating at this temperature is that the rotating of the kerogen content of the shale yields 100% gas thereby eliminating the need for costly above ground equipment for separating out liquids or otherwise treating the gas.

The process presented herein produces an operating temperature within the shale bed which has been found to be constant, throughout the bounds of a reaction zone, from the edge adjacent the borehole heater, to the outermost perimeter of the reaction zone. By maintaining a specified temperature of the heater, this operation will continue for an extended period, estimated for at least five years and with the parameters as called for in the present invention, the volume and BTU value of the product gas, remain constant. By maintaining the shale body temperature constantly at 1200 degrees F. the entire reaction upon the kerogen with the shale occurs in the shale formation with this reaction progressively radiating outwardly from the central borehole. As the kerogen is turned from a solid state to a gaseous state, it is moved inwardly toward the borehole and the voids which contained the kerogen become black body radiators serving to maintain the constant temperature across the reaction zone.

Accordingly, one of the objects of the present invention is to provide an improved process for the gasification of oil shale in situ including the controlled application of heat within a borehole without any pre-treatment of the shale bed.

Another object of the present invention is to provide an improved process for the gasification of oil shale in situ including the application of a constant degree of heat within an undisturbed shale bed and extracting gas at a substantially constant rate from a heater-containing borehole for a period of several years.

A further object of the present invention is to provide an improved apparatus for the gasification of oil shale in situ including a downhole gas-fired heater assembly containing a fuel-gas line with a burner, combustion air line, burner exhaust line and a product gas line communicating with the exterior of the heater assembly.

Still another object of the present invention is to provide an improved oil shale gasification system comprising a compact assembly of a downhole heater connected with and controlled by, above ground monitoring and regulating devices for fuel-gas and combustion air and including elements constantly monitoring the heater temperature.

With these and other objects in view which will more readily appear as the nature of the invention is better understood, the invention consists in the novel process and construction, combination and arrangement of parts hereinafter more fully illustrated, described and claimed, with reference being made to the accompanying drawings in which:

BRIEF DESCRIPTION OF THE DRAWINGS

Similar reference characters designated corresponding parts throughout the several views of the drawings.

DESCRIPTION OF THE PREFERRED EMBODIMENT

Figure 1:
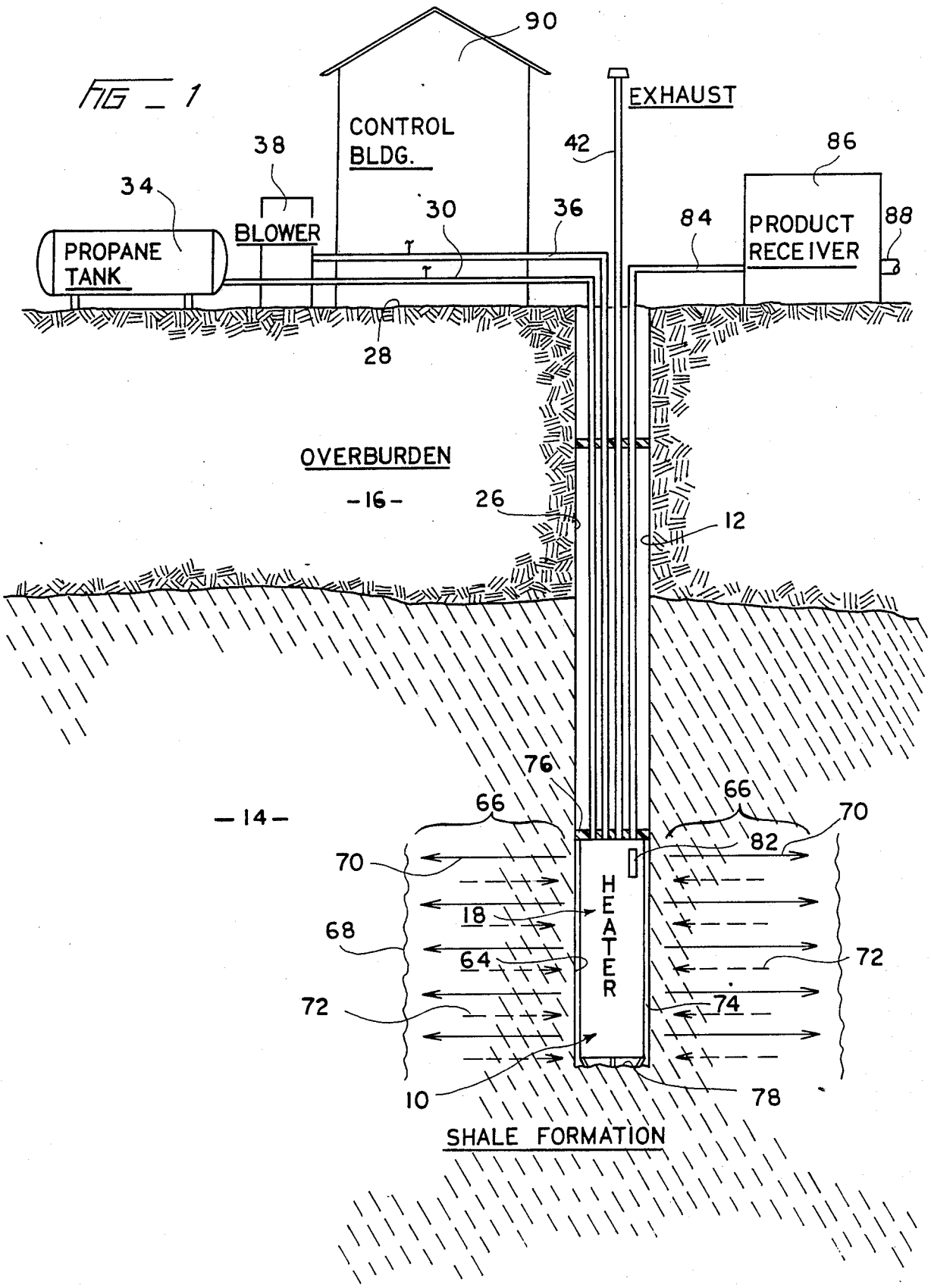
FIG. 1 is a vertical elevation, partly in section, of an oil shale gasification system according to the present invention.

Referring now to the drawings, particularly FIG. 1, the present invention will be understood to relate to an in situ system for the recovery of gas from shale formations. Included is a unitary heater assembly, generally designated 10 which is lowered into a borehole 12 drilled into a shale formation 14 lcoated beneath overburden 16.

Extensive shale deposits exist throughout a sizable area of this country and the value of the organic contents thereof has long been acknowledged. Until this time, no one has developed an economical process and apparatus to extract natural gas from the kerogen therein. Without disturbing the natural integrity of a shale bed, the instant process involves the drilling of the borehole 12 through the overburden 16 and into the shale formation 14. The borehole 12 should be at least 10 feet deep within the confines of the shale 14, since a typical height for the heater assembly is 10 feet and all of the cylindrical housing 18 of the heater assembly should be encapsulated by the shale. Many shale deposits are located beneath overburden of less than a ten foot depth and since drilling through the shale is relatively easy, it will follow that the time and expense of providing the borehole 12 will be quite reasonable.

Figure 2:
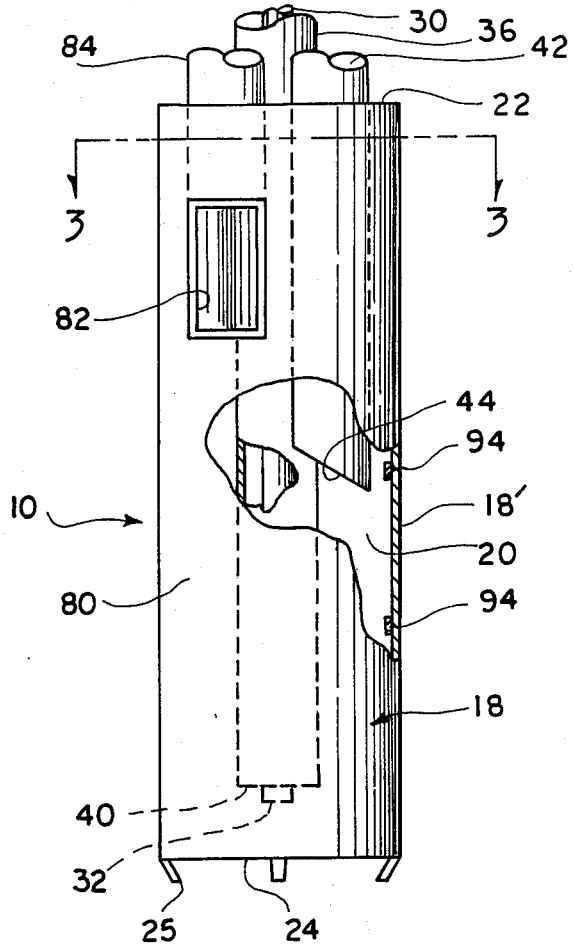
FIG. 2 is an enlarged elevational view, partly in section, of the heater assembly of FIG. 1.
Figure 3:
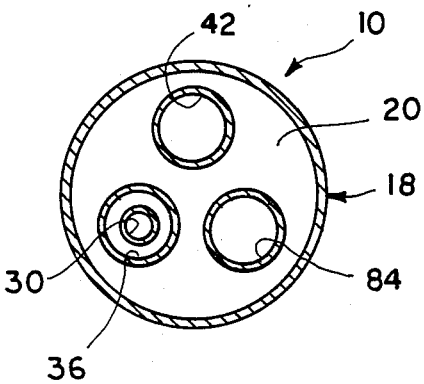
FIG. 3 is a horizontal sectional view, taken along the line 3—3 of FIG. 2.

As shown most clearly in FIG. 2, the cylindrical housing 18 of the heater assembly 10 defines an enclosed interior 20 bounded by a top wall 22 and bottom wall 24 having supports or feet 25. The purpose of the heater is to deliver a substantially constant amount of the heat to the surrounding body of shale 14 and in this respect it will be appreciated that a close fit exists between the periphery of the housing 18 and the wall 26 of the borehole. As an example, the heater housing may be ten inches in diameter and disposed within a 12 inch borehole, thereby insuring a definite but minimal lateral clearance therebetween. Special heat resistant stainless alloys are used in the construction of the heater assembly 10. A typical available alloy has been found to satisfactorily withstand exposure to temperatures of 2500 degrees F. for an extended period.

Four distinct conduits communicate between the ground surface 28 and the interior 20 of the heater housing and include a fuel-gas supply line 30 terminating in a suitable gas burner head 32 juxatposed the housing bottom wall 24. Fuel, such as propane gas, is supplied from an above-ground tank 34 to the line 30 leading to the burner 32. To support the combustion of this gas fuel, a combustion-air line 36 leads from a blower 38 and terminates in a bottom opening 40 adjacent the burner head 32. For maximum ease of assembly, installation and burner control, the air line 36 is preferably concentrically disposed about the fuel gas line 30 and maintained in this relationship by suitable spacers (not shown). To carry away the nominal amount of products of combustion, an exhaust line 42 is likewise mounted through the housing top wall 22 with its lower end 44 disposed intermediate the height of the housing and an upper discharging end in the form of a standpipe 46.

The remaining, fourth circuit will be described hereinafter, following a description of the process of the invention.

With the heater assembly 10 lowered to a depth fully surrounded by the shale formation 14, fuel gas from the supply tank 34 is admitted into the gas fuel line 30 upon opening of the manula value 48. This line includes an actuator value 50 regulated by temperature control means 52 connected thereto, as well as a flow meter 54 providing an instant, visual indication of the volume of gas being consumed.

Support for combustion of the fuel gas in the immediate area of the burner head 32 is accomplished by actuation of the air blower 38 which may comprise any well known fan apparatus supplied with a filtered intake 56 and suitable volume regulating means such as a variable-speed motor or adjustable dampers (not shown). In this manner, fresh air is directed through the air line 36 to the burner head 32, in an as required fashion. Pressure gauges 58,60 and an intermediate automatic valve 62 allow monitoring and regulation of the volume of fresh air being supplied to the gas burner 32. Further control means will be discussed hereinafter.

With the burner 32 operating, the temperature of the housing 18 becomes elevated and heat is conducted to the juxtaposed inner ring 64 of the shale formation surrounding the heater assembly. Initially, the temperature of the shale is slowly elevated above its ambient temperature, in the area immediate the heater. This temperature rise gradually radiates outwardly and when a temperature of 1200 degrees F. is reached in the shale body, reaction occurs in the kerogen to convert it to the gaseous state. The radial extent of this ever increasing reaction zone 66 is determined by the range of this constant zone of 1200 degree temperature within the shale. The very conversion of the contained kerogen to a gaseous state as this reaction zone is increased in diameter is supported by maintenance of this temperature constant and occurs due to the formation of black body radiators in the voids formed by the conversion of the kerogen to a gas. The outer ring of this reaction zone is depicted as at 68 in FIG. 1 of the drawings. Continued maintenance of the 1200 degree temperature will be understood to progressively expand the radius of this reaction zone 66 with the same temperature evident at the outer ring 68 as the inner ring 64, even though the mass of volume of the increasing outer ring area is constantly increasing in an amount disproportionate to the increase in the radius of the reaction zone. It is projected, from actual field operation of the present system, that the described reaction will continue for a period of at least five years, with the resultant outer reaction zone then being extended to a radius of 50 feet.

The radiant heater transfer is reflected in FIG. 1 of the drawings by the arrows 70 while the path of the converted gas is represented by the inwardly directed arrows 72. It is unique with the instant process, that throughout the burner operation and maintenance of the 1200 degree temperature, the entire expanse of the reaction zone will be held to this temperature, the volume and BTU rating of the converted gas will remain constant and the amount of fuel gas consumed to maintain the reaction, will remain substantially constant.

As the gas migrates through the reaction zone 68 it ultimately reaches the inner ring 64 thereof and thence passes into the gas space 74 as defined by the thin, cylindrical space intermediate the heater housing 18 and borehole wall 26. The vertical limits of this gas space are restricted to the height of the heater assembly by the inclusion of a horizontal seal member 76 spanning the expanse of the borehole 12 immediately atop the heater top wall 22. This air impervious barrier, coupled with the borehole floor 78 will be seen from FIG. 1 to restrict all gas directed from the reaction zone into the gas space 74 surrounding the heater assembly external periphery 80.

The produced gas collecting within the gas space 74 is extracted therefrom by the provision of a vertically disposed gas opening 82 formed in the housing periphery 80, adjacent the heater top wall 22. Directly communicating with this gas opening 82 is a vertically disposed product gas line 84, extending upwardly through the heater top wall 22 and thence up through the borehole 12 to the surface 28 where the gas line enters a product receiver 86. This receiver may include necessary well known support equipment such as apparatus for removing condensation formed as the heated gas rises through the cooler product gas line 84 to the surface 28. From the receiver 86, the gas is delivered by a feeder line 88 to the natural gas transmission line (not shown).

Figure 4:
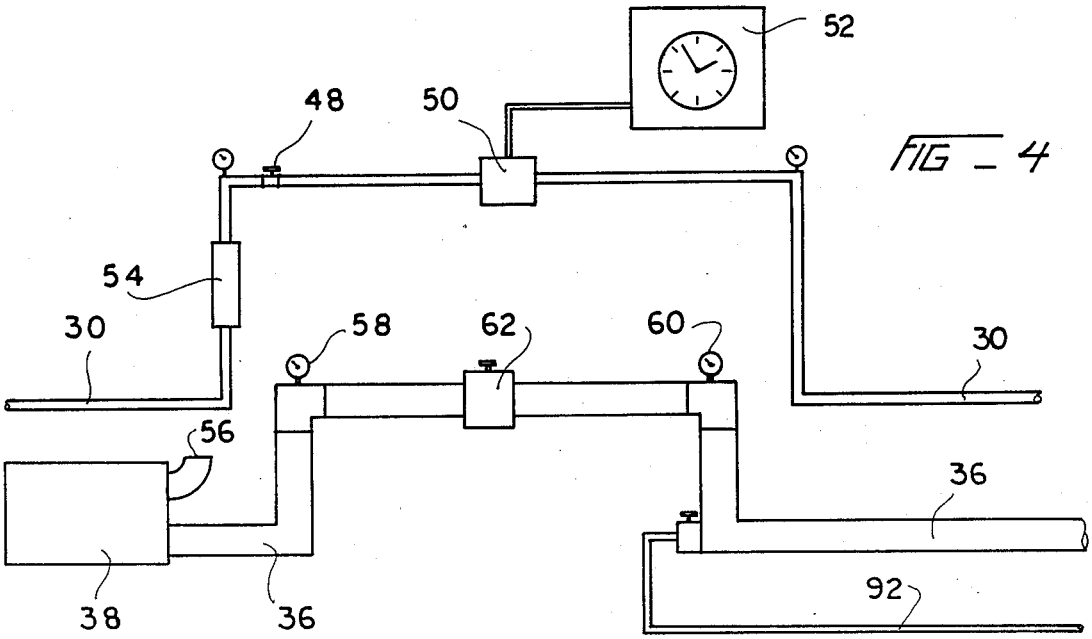
FIG. 4 is a diagrammatic view of monitoring and control components utilized above ground with the present invention.

The regulating apparatus as depicted in FIG. 4 of the drawings will be understood to be conveniently located within a suitable control building 90 situated adjacent the borehole 12. The flow meter 54 in the fuel supply line 30 will record the fuel gas passing therethrough while the actual volume of fuel gas admitted to the heater gas burner head 32 is automatically controlled by means of the actuator valve 50 as regulated by the connected temperature control clock 52. Adjustment of the valve 62 in the combustion air line 36 maintains the desired pressure as reflected by the upstream pressure gauge 58. An air line 92 joined to the combustion air line 36 communicates with a plurality of thermocouples 94 vertically spaced apart within the interior of the heater assembly side wall 18'. In this manner, a constant maintenance of the temperature as produced within the heater assembly is achieved and any alteration thereof compensated for by variation of the combustion air supporting the fuel gas.

During the operation of the present invention, the gas being extracted from the shale migrates in the direction of least resistance, namely horizontally in the direction of the arrows 72, toward the very least area of resistance, or the concentric void defining the gas space 74 surrounding the heater assembly 10. This gas space actually may extend a slight distance above the heater top wall 22 to the laterally extending seal 76 to provide a positive gas holding area. The released gas therebeneath is thereafter forced upwardly through the gas opening 82 in the housing side wall 18' and continues upwardly through the attached product gas line 84.

By the present invention, natural gas is produced which, on average, will yield over 70 MCF daily and at a value of over 800 BTU. An important feature is that this production will be substantially constant for a significant period of time, such as five or more years. During this period, the reaction zone 66 will progressively increase in diameter and although the encompassed volume of the shale body within this zone is increasing at a far greater disproportionate rate than the increase in this diameter, the 1200 degree temperature is maintained constant throughout the zone and the natural gas output volume and BTU value are constant.

It appears that the most feasible arrangement for a gas field is to sink a plurality of the boreholes 12 one hundred feet apart along x and y axes. This conclusion is arrived at from test installations and the resultant calculations indicating that any one borehole-heater system will maintain the above described operation for a period of at least five years, at which time the reaction zone will have extended a radius of 50 feet.

Typical installations to date according to the present invention have shown that upon start-up of a new well, natural gas has been recovered after approximately 8 hours of operation of the heater assembly. After 7 days, the heater assembly has produced a stabilized, measurable reaction zone within the shale bed formation. In approximately one month, the temperature and production have totally stabilized and natural gas is extracted thereafter, at a rate of over 70 MCF and 800 BTU, all at a fuel gas cost of less than 15 cents per MCF.

I claim:

1. A method for the in situ recovery of natural gas from an undisturbed shale bed formation in a condition ready for transmission through a gas pipeline to end users and substantially without the formation of liquid products comprising:

forming a heater assembly having an elongated substantially cylindrical outer housing, providing said elongated heater assembly with an interior containing a fuel gas burner therewithin joined to an upwardly extending fuel gas supply line and including in said interior an upwardly extending product gas line disposed adjacent an upwardly extending combustion air line, drilling a borehole into a subterranean shale bed formation, lowering said heater assembly into said borehole to a position surrounded by the shale bed formation with said borehole having been drilled to define a diameter relative said heater assembly housing insuring a close fit therebetween while providing a gas space therebetween, supplying fuel gas to said fuel gas supply line from fuel gas supply means disposed above ground, supplying combustion air to said combustion air line from combustion air supply means disposed above ground, regulating said gas supply means and said combustion air supply means to operate said fuel gas burner to heater said heater assembly outer housing and thence, through convection and radiation, to progressively and radially heat the surrounding undisturbed shale bed formation, monitoring the temperature of the heated shale bed formation and manipulating said regulating of said supply means to maintain the temperature of the heated shale bed formation at approximately 1200 degrees F., insuring, during said regulating of said gas supply means and said combustion air supply means, that a temperature of over 1000 degrees F. is maintained, insuring, during said monitoring of the temperature of the heated shale bed formation, that a temperature of less than 1500 degrees F. is maintained, whereby, maintenance of the temperature at approximately 1200 degrees F. reports the kerogen content of the shale bed formation to evolve substantially solely natural gas with the natural gas migrating to said borehole adjacent said heater assembly without significant disturbance of the shale bed formation, collecting the natural gas from said borehole through said product gas line and providing a seal member within aid borehole above said heater assembly, whereby natural gas within said borehole is precluded from exiting said borehole other than through said product gas line.

2. The method according to claim 1 wherein, said fuel gas is propane.

3. The method according to claim 1 wherein, said fuel gas supply line is disposed within said combustion air supply line.

* * * * *